United States Patent [19]

Dowling et al.

[11] Patent Number: 4,495,805

[45] Date of Patent: Jan. 29, 1985

[54] IN-SITU PERMEABILITY DETERMINING METHOD

[75] Inventors: Donald J. Dowling; Albert P. Richter, Jr.; Wayne F. Warren; Dan M. Arnold, all of Houston, Tex.

[73] Assignee: Texaco Inc., White Plains, N.Y.

[21] Appl. No.: 475,590

[22] Filed: Mar. 15, 1983

[51] Int. Cl.[3] ..... E21B 47/10

[52] U.S. Cl. ..... 73/155

[58] Field of Search ..... 73/155, 38; 166/250; 364/422

[56] References Cited

U.S. PATENT DOCUMENTS 3,871,218 3/1975 Louis ..... 73/155

4,353,249 10/1982 Lagus et al. ..... 73/155

*Primary Examiner*—Jerry W. Myracle

*Attorney, Agent, or Firm*—Robert A. Kulason; Ronald G. Gillespie

[57] ABSTRACT

A method of determining the permeability of a particular stratum in an earth formation traversed by a borehole includes injecting a liquid into the borehole at a first pressure thereby causing liquid flow into the stratum. A first flow rate of the liquid is determined at the first pressure. The pressure of the liquid being injected into the borehole is then changed to a second pressure level and a second flow rate of the liquid flowing into the stratum is determined at the second pressure. An indication of the permeability of the stratum is then derived in accordance with the two pressures, the two flow rates and known characteristics of the stratum.

8 Claims, 2 Drawing Figures

IN-SITU PERMEABILITY DETERMINING METHOD

BACKGROUND OF THE INVENTION

Field of the Invention

The present invention relates to a method for determining the permeability of a material in general and, more particularly, to determine the permeability of a stratum of an earth formation from a borehole.

SUMMARY OF THE INVENTION

The present invention determines the permeability of a particular stratum in an earth formation traversed by a borehole by injecting a liquid into the borehole at a first pressure so as to cause liquid flow into the stratum. The flow rate of the liquid into the stratum is determined at the first pressure. The pressure of the injection liquid is changed to a second pressure and the flow rate of the liquid into the stratum is determined at the second pressure. An indication of the permeability of the stratum is derived in accordance with the first and second flow rates, the first and second pressures, and known characteristics of the stratum.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

The determination of the permeability of a petroleum reservoir has in the past involved determining the flow of fluid in an uncased injection well and monitoring the same fluid flow below the zone being investigated to determine the radial flow into the reservoir. Darcy's law for horizontal radial flow steady state is expressed as $$1.\ Q=[2\pi kh\ (p_w-p_e)/[\mu 1n\ (r_e/r_w)],$$

where k is permeability, h is a formation thickness, $\mu$ is a fluid viscosity, $p_w$ is the wellbore pressure, $p_e$ is the reservoir pressure, at a distance $r_e$ from the borehole center is the equivalent well drainage radius, and $r_w$ is the radius of the wellbore. Darcy's law may then be rewritten as the following expression to be solved for the permeability k $$2.\ k=[Q\mu 1n\ (r_e/r_w)]/2\pi h\ (p_w-p_e).$$

The problem with the equation 2 is that $p_e$ is an estimated value.

The present invention permits the determination of the reservoir permeability without estimating the reservoir pressure $p_e$. The present invention makes flow velocity measurements at two or more surface controlled pressure levels that renders the knowledge of $p_e$ unnecessary as shown in the following equations by letting $Q_1$ be the flow into the permeable stratum at wellbore pressure $p_{w1}$ and $Q_2$ will be the flow at pressure $p_{w2}$ and assuming $p_{w2}$ is greater than $p_{w1}$ we can let $$3.\ C=[2\pi kh]/\mu ln\ (r_e/r_w)$$

and rewrite equation 1. as follows:

$$4.\ Q=C\ (p_w-p_e)$$

$$5.\ p_w-p_e=Q/C,$$

substituting for Q, and $p_w$ we have $$6.\ p_{w2}-p_e=Q_2/C$$

$$7.\ p_{w1}-p_e=Q_1/C.$$

Subtracting equation 7 from equation 6, we have $$8.\ p_{w2}-p_{w1}=(Q_2-Q_1)/C,$$

let $$9.\ Q_1=(Q_{Bore}\text{ at a location B-}Q_{Bore}\text{ at a location A})\Delta Q_{Ba1}$$

$$10.\ Q_2=(Q_{Bore}\text{ at location B-}Q_{Bore}\text{ at location A})=\Delta Q_{BA2}$$

were $Q_{Bore}$ represents borehole liquid flow rate, $\Delta Q_{BA1}$ and $\Delta Q_{BA2}$ then represents liquid flow into the stratum for pressures $p_{w1}$ and $p_{w2}$, respectively. Rewriting equation 2, we have $$11.\ k=[(\Delta Q_{BA2}-\Delta Q_{BA1})\mu ln\ (r_e/r_w)]/2\ \pi h\ (p_{w2}-p_{w1})$$

Figure 1:
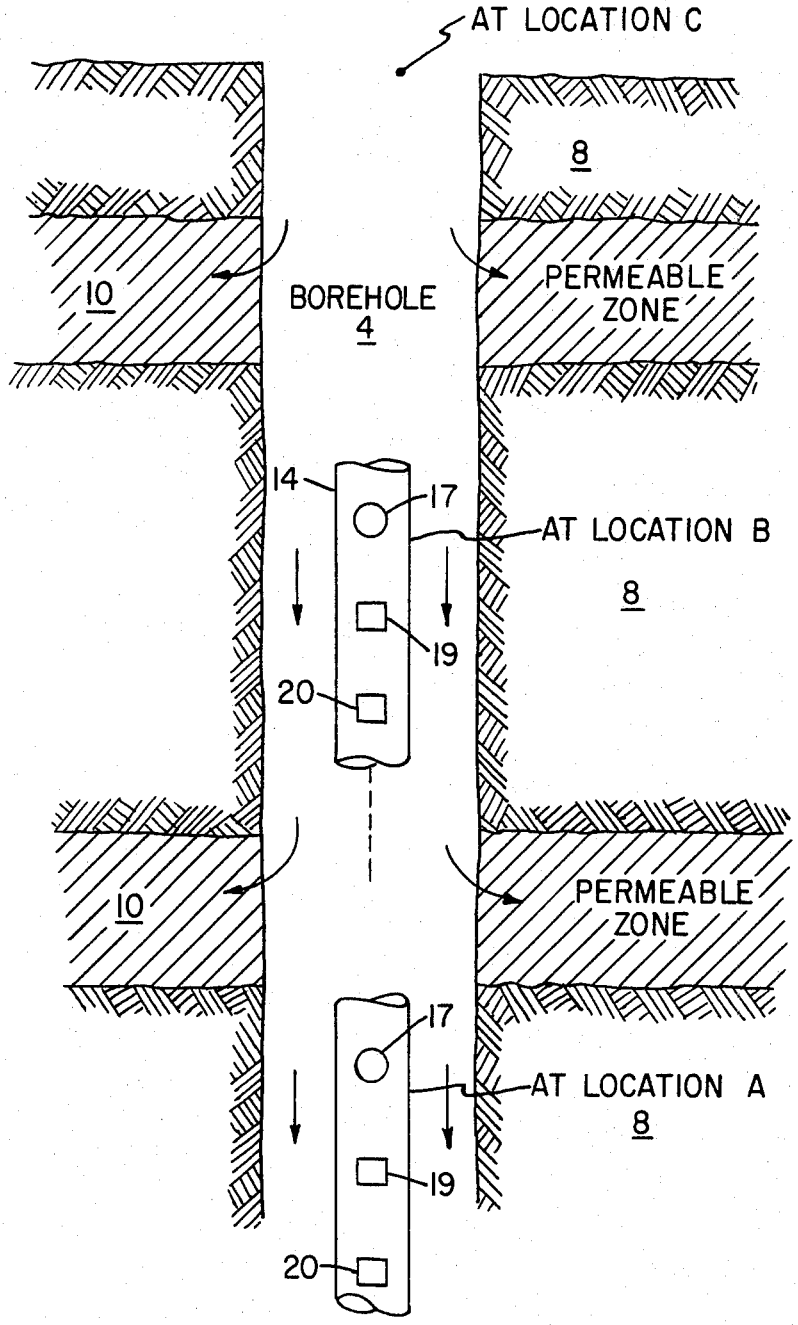
FIG. 1 is a representation showing the relationship of a radioactive well logging tool to permeable zones of an earth formation during a practicing of the present invention.
Figure 2:
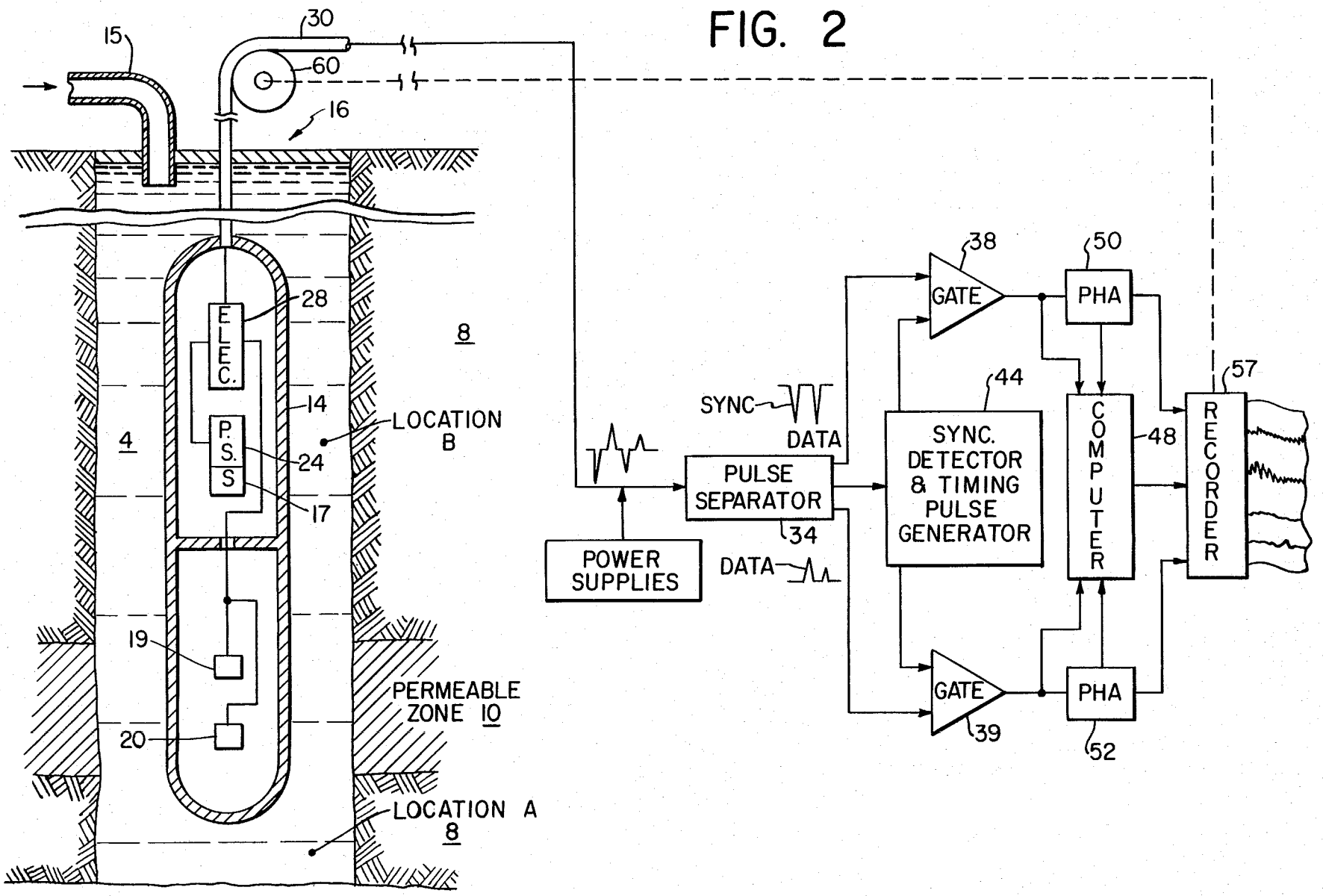
FIG. 2 is a schematic representation of a radioactive well logging system that may be used in the practice of the present invention.

The practice of the present invention may be seen readily in FIGS. 1 and 2. In FIG. 1 an uncased borehole 4 traverses an earth formation having non-permeable zones such as shale 8, and permeable zones 10. During reservoir flooding operations water is pumped into borehole 4 at a pressure $p_1$ and flows in the direction of the arrows into the permeable zones to flush out and drive ahead of it the crude oil contained in those zones. By way of example we have just shown this section of the formation as having two permeable zones. The formation itself may have several permeable zones. The number of permeable zones does not affect the practice of the present invention.

A logging tool 14 having a neutron source 17 and gamma ray detectors 19 and 20 is intially positioned at a location A in the borehole which is below a permeability zone 10 of interest. It should be noted that whether the flow measuring is done below a zone of interest initially or above a zone of interest initially is immaterial from the practice of the present invention, although the preferred practice is to initially make the measurement below the permeable zone of interest and then move it up to above that zone to keep a proper tension on the well logging cable. Nor is it mandatory that the well logging tool be stationary at the time of measurement. There could be measuring by moving past location A and past location B. The actual measurement of the fluid flow will be described hereinafter and is fully disclosed in U.S. Pat. Nos. 4,032,781 and 4,189,638.

Suffice to say that at this time after the flow measurements are made at location A, well logging tool 14 is moved to location B and again flow measurements are made. The difference of flow as noted earlier, corresponds to the radial flow of the water $\Delta Q_{BA1}$ into permeability zone 10, located between locations A and B. The flow $\Delta Q_{BA}$ is the Q of equations 4 and 9. Logging tool 14 can then be moved up to location C and again fluid measurements made with the radial flow of fluid into permeability zone 10 between locations B and C being the difference in borehole flow at locations B and C. When all the measurements are concluded water again is injected into borehole 4 at a greater pressure $p_2$ than before and the measurements are repeated a second time at all of the locations for the determination of the permeability. The flow into permeability zone 10 at the new pressure is $Q_{BA2}$.

Referring now to FIG. 2, a source of drive water (not shown) pumps water into borehole 4 at a predetermined pressure through a pipe 15. Borehole 4 has a metal cap 16 to seal off the borehole to prevent the water from rising out of the borehole. Further, as noted earlier, the pressure at which the water is pumped into borehole 4 can be varied by an operator. Well logging tool 14 includes a neutron source 17 and conventional type gamma ray detectors 19 and 20. Neutron source 17 is supplied by power from a power supply 24 while the conventional electronics connect to the power supply 24 and to gamma ray detectors 19 and 20. The details of the operation of this tool for sensing water flow is fully described in U.S. Pat. No. 4,032,781. The theoretical discussion in measuring the flow is not necessary to an understanding of the present invention. Suffice to say that electronics 28 provides pulses up a logging cable 30 to a pulse separator 34 which separates the pulses according to which gamma ray detector 19 or 20 provided the pulses. The pulses from one detector, such as detector 19, are provided to a gate 38 while the pulses from detector 20 are provided to gate 39. It should also be noted that the aforementioned well logging system includes providing sync pulses downhole which are provided to a pulse separator 34 to sync detector and timing pulse generator 44. The outputs of gates 38 and 39 are provided to a computer 48 and to pulse height analyzers 50 and 52, respectively. The outputs of pulse height analyzers 50 and 52 along with the outputs from computer 48 are provided to a recorder 57 which is receiving a signal from a sheave wheel rail 60 which is cooperating with cable 30 to control recorder 57 in accordance with the depth of well logging tool 14 in borehole 4.

Computer 48 makes the necessary flow determinations in accordance with the technique disclosed in U.S. Pat. No. 4,189,638 and from the flow determinations and data fed into the computer relating to the formation characteristics and the pressures of the fluid in borehole 4 to determine the permeability of the various zones in the earth's formation.

It should be noted that the foregoing examples show that the operator increased the pressure to the predetermined value. It is possible to locate a pressure sensor in pipe 15 or any other convenient location and convert it to digital signals and provide it to computer 48. Thus the operator could then vary the pressure and not necessarily to a predetermined pressure, but that there is a sufficient change in pressure with the computer to then utilize the two different sensed pressures to derive the permeabilities.

The present invention need not necessarily be restricted to drive water but could be any drive fluid, even a chemical system of drive, fluids, nor is the invention restricted to the use of radioactive well logging tools. The basic requirements are an ability to detect fluid flow above and below a permeable zone of interest for at least two different pressures of fluid being provided to borehole 4.

What is claimed is:

1. A method of determining the permeability of a stratum in an earth formation traversed by a borehole which comprises the steps of:

injecting a liquid into the borehole at a first pressure so as to cause liquid flow into the stratum, determining a first flow rate of the liquid into the stratum at the first pressure, injecting the liquid into the borehole at a second pressure causing liquid flow into the stratum, determining a second flow rate of the liquid into the stratum at the second pressure, and deriving an indication of the permeability of the stratum in accordance with the pressure, the two flow rates and a known characteristic of the stratum; and each determining step includes:

measuring the flow rate of the liquid in the borehole below the stratum, and deriving the flow rate of the liquid into the stratum in accordance with the difference between the two measured flow rates.

2. A method as described in claim 1 in which the measuring of the liquid flow rate in the borehole is accomplished using a radioactive well logging system.

3. A method as described in claim 2 in which the characteristic of the stratum is the thickness of the stratum.

4. A method as described in claim 3 in which the second pressure is greater than the first pressure.

5. A method as described in claim 4 in which the permeability is derived in accordance with the difference in pressure and the difference in the flow rates of the liquid into the stratum.

6. A method as described in claim 5 in which the radioactive well logging system is operated in the pulse mode of operation.

7. A method as described in claim 6 in which the radioactive well logging system is operated in a continuous mode of operation.

8. A method as described in claim 7 in which the liquid is injected at an unknown pressure and which further comprises the step of measuring the pressure of the injection liquid, the pressure of the liquid is then increased and sensing a second pressure of the injection liquid and the indication of permeability is derived in accordance with the sensed pressures and the determined flow rates into the stratum.

* * * * *